US009894980B2

(12) United States Patent
Kim

(10) Patent No.: US 9,894,980 B2
(45) Date of Patent: Feb. 20, 2018

(54) ROTARY-PUSH TYPE COSMETIC CONTAINER

(71) Applicant: CTK CO. LTD., Seongnam-si, Gyeonggi-do (KR)

(72) Inventor: Jin Woo Kim, Gwangmyeong-si (KR)

(73) Assignee: CTK CO. LTD., Seongnam-si Gyeonggi-Do (KR)

( * ) Notice: Subject to any disclaimer, the term of this patent is extended or adjusted under 35 U.S.C. 154(b) by 0 days.

(21) Appl. No.: 14/765,963

(22) PCT Filed: Apr. 30, 2015

(86) PCT No.: PCT/KR2015/004430

§ 371 (c)(1),
(2) Date: Aug. 5, 2015

(87) PCT Pub. No.: WO2016/060347

PCT Pub. Date: Apr. 21, 2016

(65) Prior Publication Data

US 2017/0224087 A1 Aug. 10, 2017

(30) Foreign Application Priority Data

Oct. 14, 2014 (KR) ..... 10-2014-0138409

(51) Int. Cl.

| | |
|---|---|
| ***A45D 40/00*** | (2006.01) |
| ***A45D 40/22*** | (2006.01) |
| ***B65D 47/24*** | (2006.01) |

(52) U.S. Cl.

CPC ..... *A45D 40/0075* (2013.01); *A45D 40/22* (2013.01); *B65D 47/244* (2013.01)

(58) Field of Classification Search

CPC ..... A45D 2200/056; A45D 33/34; A45D 40/0075; A45D 40/22; B65D 47/244

USPC ..... 132/299; 401/172, 174; 222/386, 387, 222/390, 405

See application file for complete search history.

(56) References Cited

U.S. PATENT DOCUMENTS

| | | | | |
|---|---|---|---|---|
| 2,163,974 A * | 6/1939 | Blett | A45D 40/0075 222/390 |
| 5,445,465 A | 8/1995 | Cardia | |
| 2009/0001102 A1 * | 1/2009 | Fang | B65D 47/2093 222/260 |

FOREIGN PATENT DOCUMENTS

| | | |
|---|---|---|
| EP | 0350661 A2 | 1/1990 |
| JP | 2001-299445 * | 10/2001 |
| KR | 20-0259351 Y1 | 1/2002 |
| KR | 10-2012-0074880 A | 7/2012 |

(Continued)

*Primary Examiner* — Todd E Manahan
*Assistant Examiner* — Jennifer Gill
(74) *Attorney, Agent, or Firm* — John K. Park; Park Law Firm

(57) ABSTRACT

The present invention provides a rotary-push type cosmetic container. The rotary-push type cosmetic container includes: a lower case; an upper case opening up and closing down with respect to the lower case; an internal container disposed in the lower case and filled with a cosmetic through the back; a rotary plate having an extraction hole at the center and moving up the internal container by rotating about a middle case in the lower case; a piston combined to the lower portion of the rotary plate to generate pressure for extracting the cosmetic in the internal container; and a nozzle plate elastically moved up and down by a spring between the piston and the rotary plate.

9 Claims, 8 Drawing Sheets

(56) References Cited

FOREIGN PATENT DOCUMENTS

| | | | |
|---|---|---|---|
| KR | 20-2013-0000760 | U | 1/2013 |
| KR | 20-2014-0000302 | U | 1/2014 |

* cited by examiner

[Fig. 1]
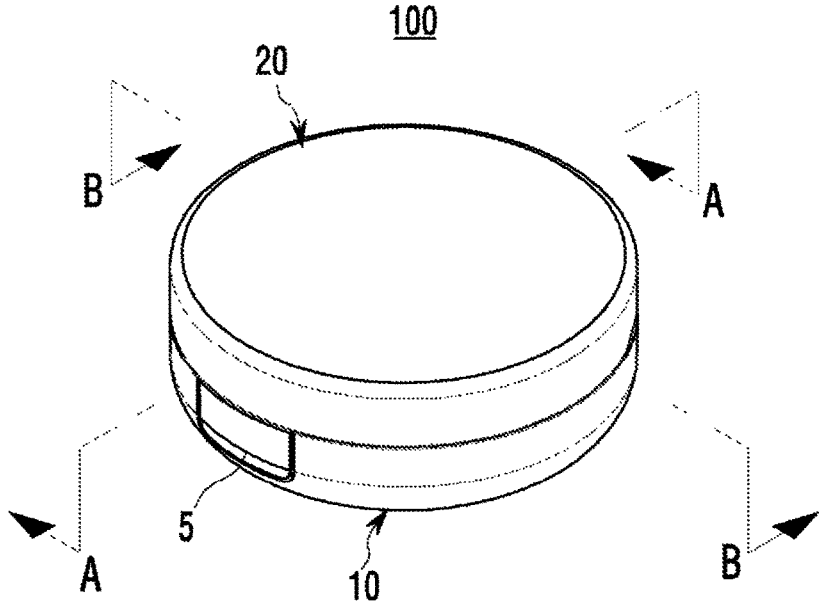
[Fig. 2]
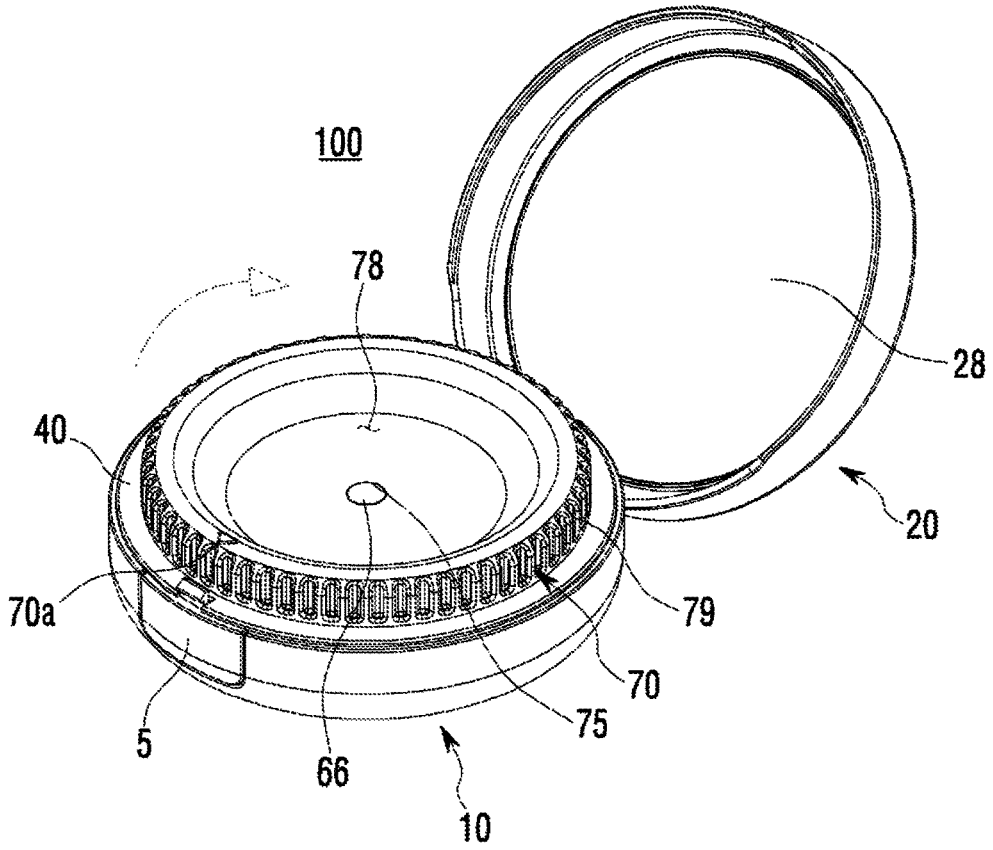

[Fig. 3]
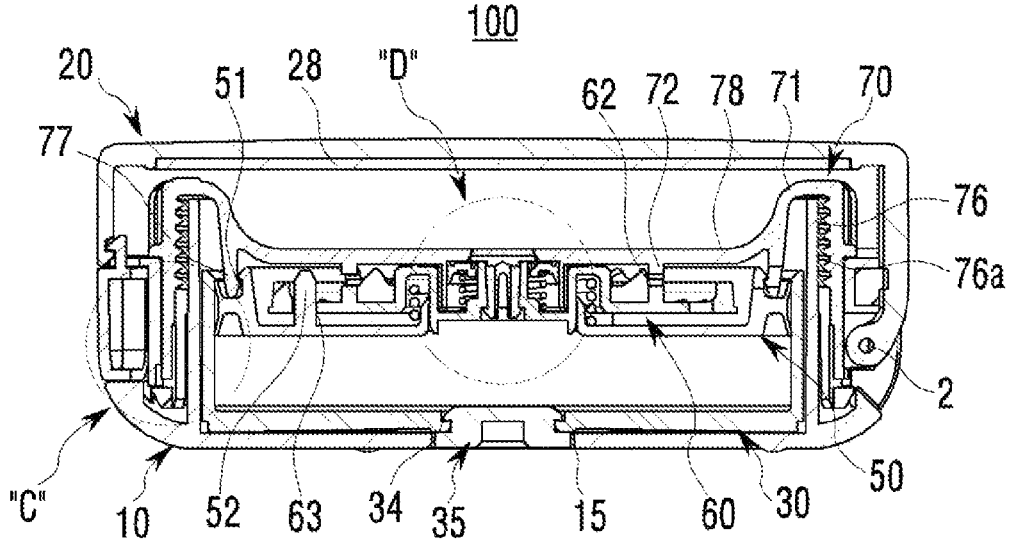
[Fig. 4]
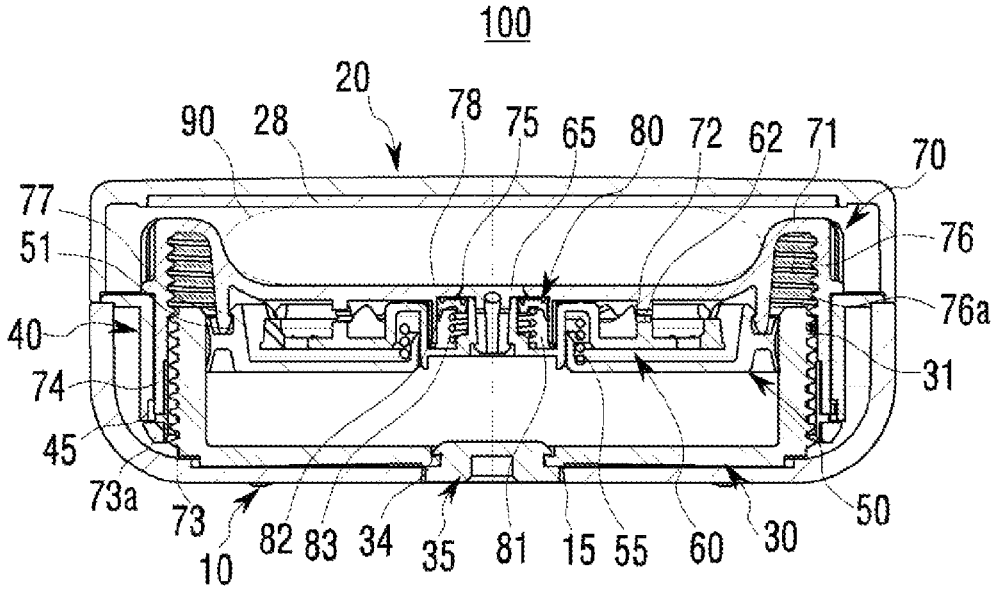

[Fig. 5]
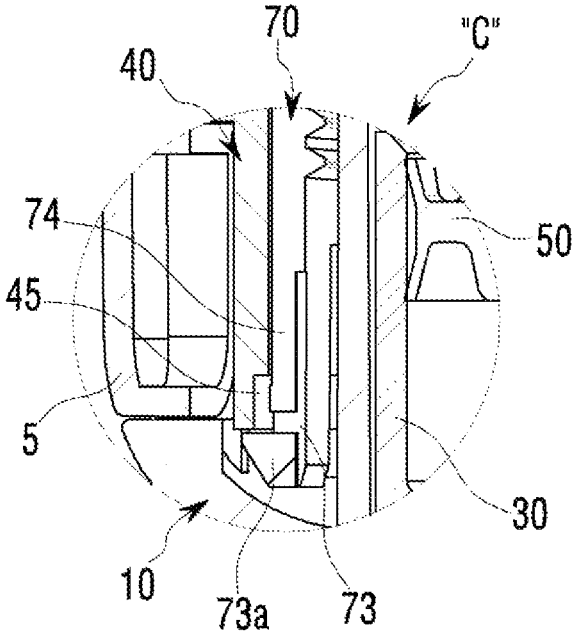
[Fig. 6]
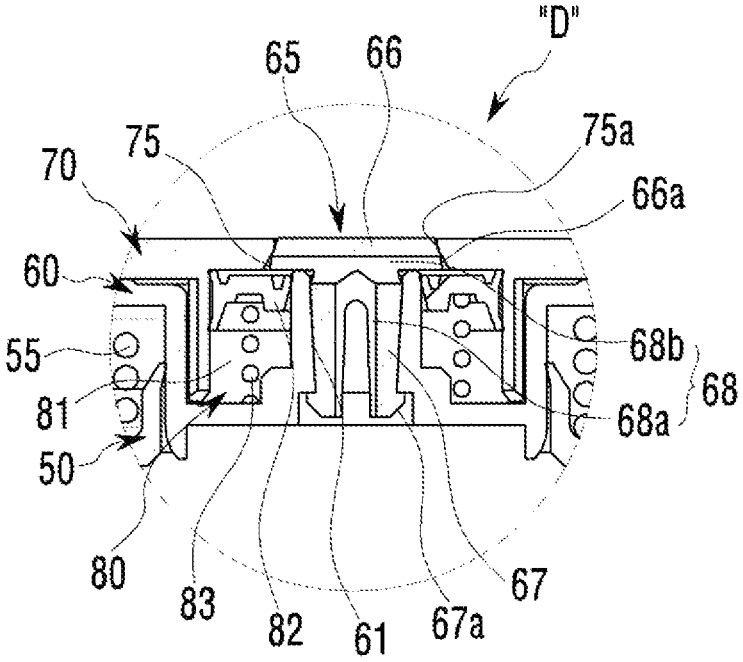

[Fig. 7]
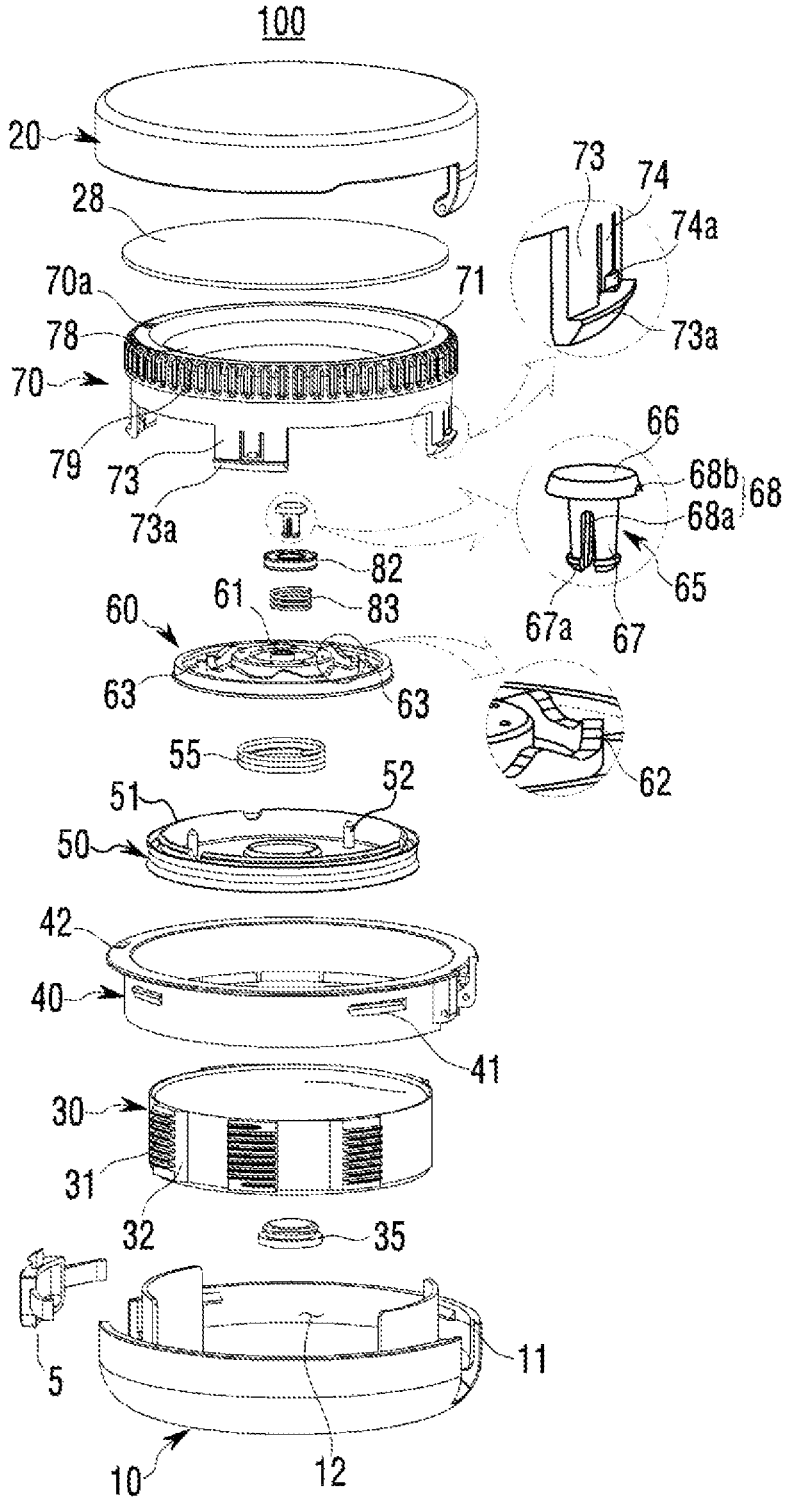

[Fig. 8]
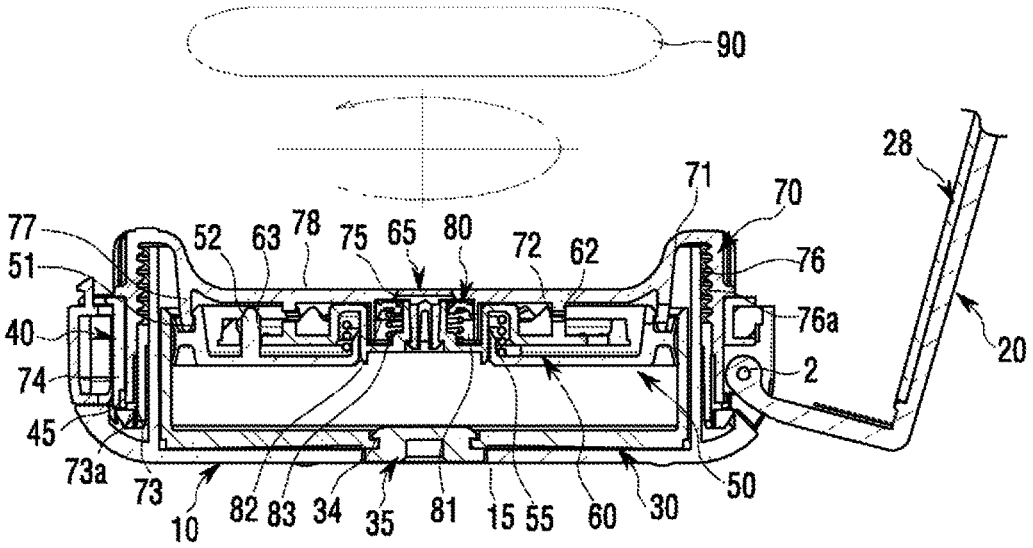
[Fig. 9]
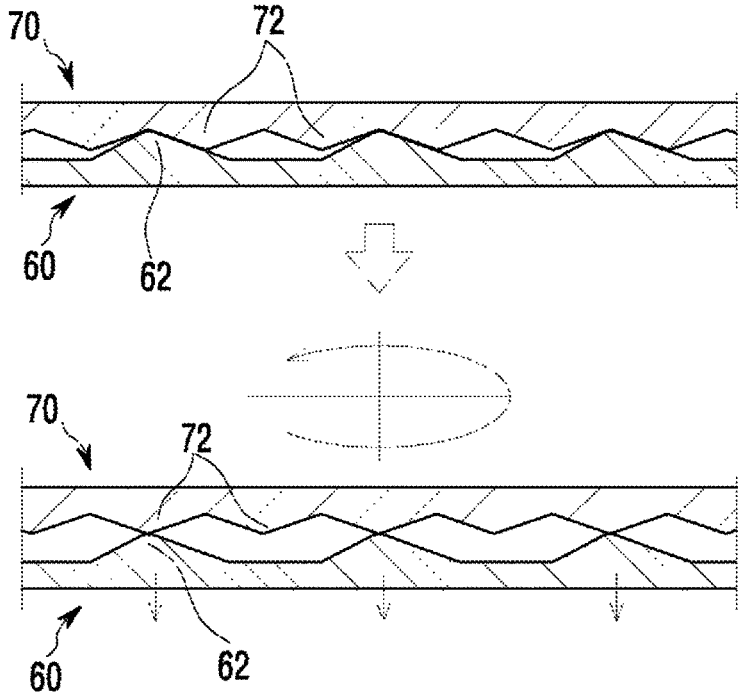

[Fig. 10]
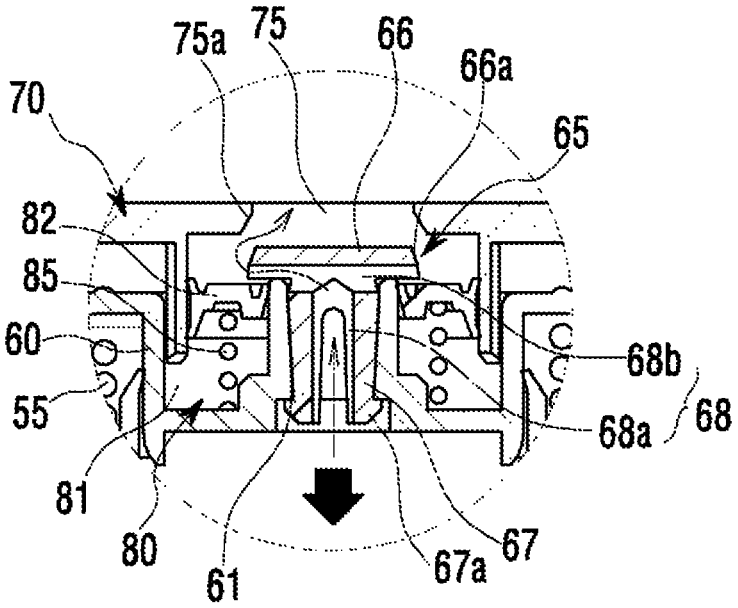
[Fig. 11]
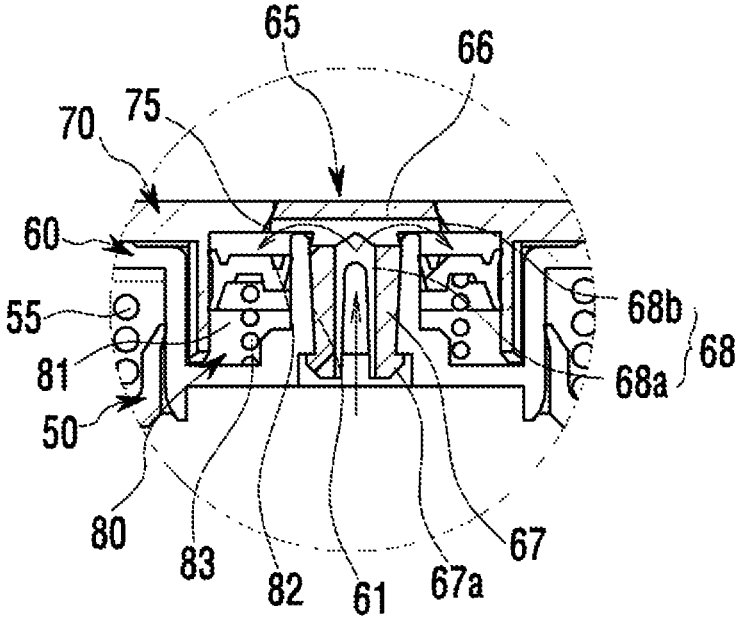

[Fig. 12]
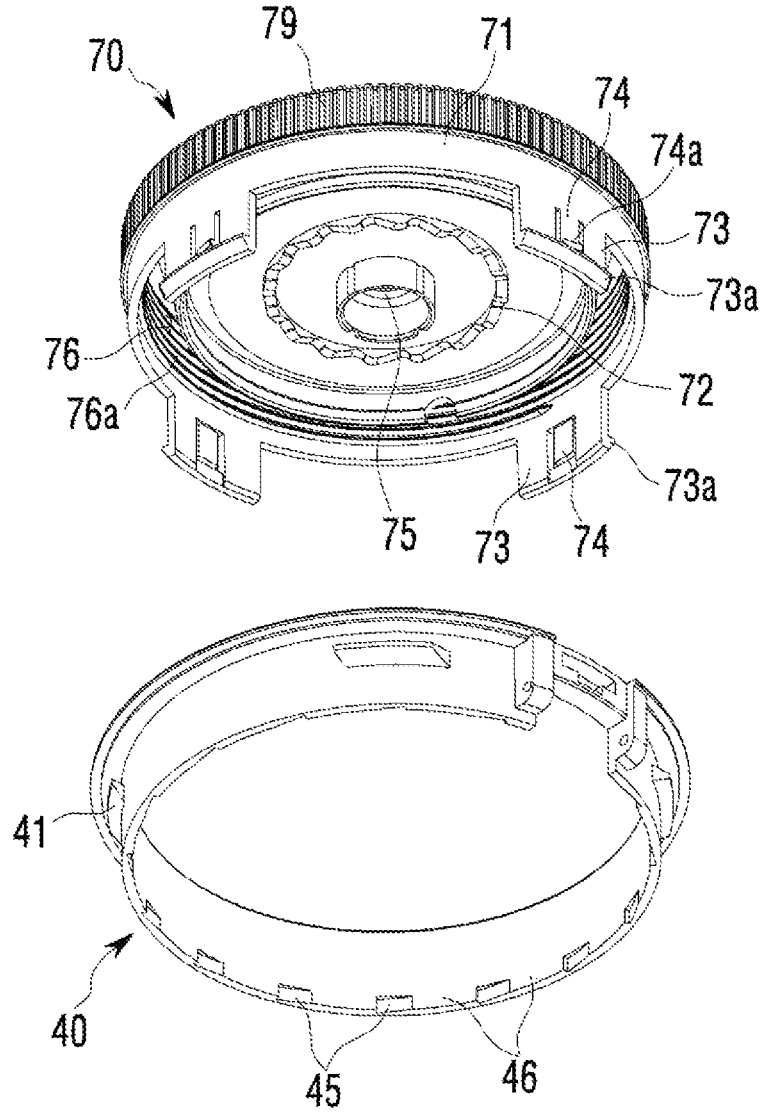

[Fig. 13]
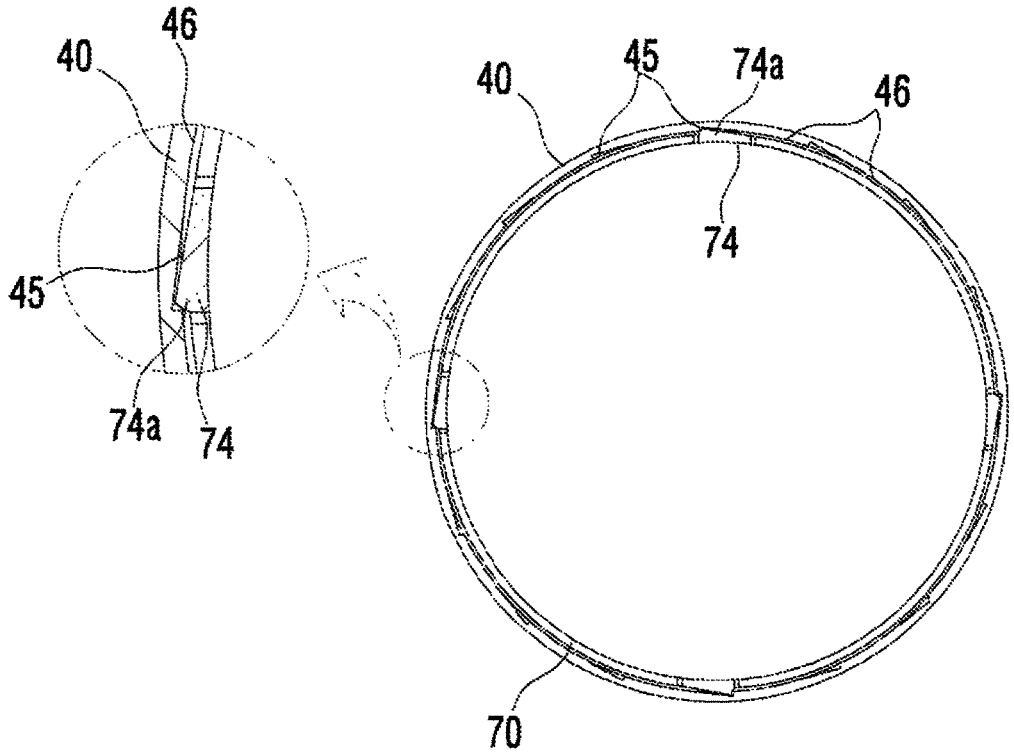

ROTARY-PUSH TYPE COSMETIC CONTAINER

TECHNICAL FIELD

The present invention relates to a rotary-push type cosmetic container. More particularly, the present invention relates to a rotary-push type cosmetic container that can easily discharge a cosmetic because an internal container keeping a cream type cosmetic is moved up by a rotary plate, and an outlet hole of the rotary plate opens and the cosmetic comes out in an appropriate amount only when the internal container is moved up, and that can sanitarily keep the cosmetic without changing the quality of the cosmetic by preventing leakage of the cosmetic or contact with air when it is carried.

BACKGROUND ART

In general, pot type containers with a wide mouth are used as containers for keeping liquid foundations or various cream type cosmetics such as BB cream, a moisturizing cream, an eye cream, a cold cream, a massage cream, and a nourishing cream.

However, cosmetics in pot type containers come in contact with air in a wide area so the quality of such products changes fast. Further, users extract the cosmetic using their fingers, so bacteria transfers from the user's fingers to the remaining cosmetic in the container, which results in contamination. Furthermore, extracting a desired amount of the cosmetic cannot be easily or accurately controlled, so it is difficult to extract an appropriate amount of cosmetic. In addition, users may excessively extract more of the cosmetic product than is needed and throw away the remaining portion after use, or put it back into the container. Accordingly, it is difficult to prevent waste when using such a pot type container.

In order to solve these problems, various type of cosmetic containers that discharge cosmetics have been proposed in the related art.

For example, disclosed in Korean Patent Application Publication No. 10-2007-0088301, is an "ejecting container" that presses and ejects a cosmetic through the top through an outlet by reducing a center angle made by a fixed plate and a rotary plate to decrease the volume of a chamber, when a container body and a cover unit are relatively rotated. However, the outlet formed through the top simply covered with the cover unit, but is always open, so it is difficult to prevent leakage of the cosmetic and effectively prevent inflow of foreign substances. Further, the cosmetic is always in contact with external air, so the possibility of change in quality of the cosmetic is a concern.

Further, disclosed in Korean Utility Model No. 20-0361671, is a "cosmetic cream container" including a container body that has: a threaded rod at the center, a piston assembly that moves along the threaded rod to discharge a cosmetic cream to the outside; an internal container lifter that moves the piston assembly along the threaded rod by rotating about the container body and has an outlet for discharging the cosmetic cream; and a valve unit that elastically operates to discharge the cosmetic cream to the outside by opening the outlet when a rotary unit rotates, in which the rotary unit includes first and second rotary bodies. However, in the cosmetic cream container, a cosmetic cream is placed on the piston assembly that is moved up by rotation of the rotary unit. Accordingly, the cosmetic cream may flow by gravity to the lower portion of the container body through a small gap between the piston assembly and the threaded rod. Further, when the cosmetic cream collects on the bottom of the container body, it cannot be taken out, so some of the cosmetic cream cannot be used. If the threaded rod bends or deforms even slightly in the process of manufacturing or assembling, it causes a structural problem wherein the piston assembly may not be stable when being move up. Further, it is difficult to manufacture the cosmetic cream container in a small size due to the structure for moving the piston assembly, thus a large container is required. However, such a large container is inconvenient to carry.

Further, proposed in Korean Patent Application Publication No. 10-2013-0102280, is an "extrusion type cosmetic case" in which as a piston is moved down along a threaded rod by rotation of an upper case and presses a cosmetic in a lower case, the cosmetic is discharged through an outlet and a hole of a boss. However, although the structure of the cosmetic case can be considered as being simple, it is difficult to ensure stable horizontal movement of the piston when it moves down along the threaded rod. Further, since the outlet and the hole for discharging the cosmetic are always open, air and foreign substances are not blocked, so there is a limit in preventing a change in quality or contamination of the cosmetic due to contact with air.

Related Art Document (Patent Document 1) Korean Patent Application Publication No. 10-2007-0088301

(Patent Document 2) Korean Utility Model No. 20-0361671

(Patent Document 3) Korean Patent Application Publication No. 10-2013-0102280

DISCLOSURE OF INVENTION

Technical Problem

Accordingly, the present invention has been made keeping in mind the above problems occurring in the related art, and the present invention is intended to propose a rotary-push type cosmetic container that can easily discharge a cosmetic because an internal container keeping a cream type cosmetic is moved up by a rotary plate, and an outlet hole of the rotary plate opens and the cosmetic comes out in an appropriate amount only when the internal container is moved up, and that can sanitarily keep the cosmetic without changing the quality of the cosmetic by preventing leakage of the cosmetic or contact with air when it is carried.

Solution to Problem

In order to achieve the above object, according to one aspect of the present invention, there is provided a rotary-push type cosmetic container that includes a lower case and an upper case opening up and closing down with respect to the lower case, in which, inside the lower case, there are disposed an internal case keeping a cosmetic and having a thread around an outer side, a middle case disposed outside the internal case inside the lower case without rotating, a piston inserted in the internal case, a nozzle plate disposed on the piston elastically by a spring, having a hole at a center where a nozzle is coupled, and having a saw-toothed portion at an edge of a top, a rotary plate thread-fastened to the thread on the outer side of the internal container, coupled to a top of the piston, rotatably combined with a middle case without moving up and down, having a saw-toothed portion at an edge of a bottom of a body, and shaped to correspond to the saw-toothed portion of the nozzle plate so that when the body is rotated, the internal container moves up, the nozzle plate elastically moves down, and a head of a nozzle moves away from an extraction hole at a center of the body, and a decompression mechanism having a decompression chamber communicating with a nozzle hole of the nozzle outside an upper portion of the hole of the nozzle plate and preventing leakage of a cosmetic by reducing internal pressure of the internal container.

Guide bars may be partially formed around the outer side of the internal container and inserted in guide grooves vertically formed on an inner side of the lower case, so the internal container may be movable up and down without rotating.

The internal container may have a back-filling hole formed through the bottom for filling a cosmetic and a sealing packing inserted in a packing hole coaxially formed through a bottom of the lower case is combined to the back-filling hole after a cosmetic is filled.

The rotary plate may have tension ribs having a vertical locking protrusion and formed with regular intervals around a bottom and the vertical locking protrusions may be locked to a lower end of the middle case, and the tension ribs may have a sub-tension rib at a center and a ratchet protrusion on the sub-tension rib for stopping rotation and ratchet grooves for locking the ratchet protrusions may be formed on an inner side of the middle case, so the ratchet protrusions may slide over the ratchet grooves in one direction by tension of the sub-tension ribs, but may be locked in the opposite direction.

A plurality of guide protrusions may be formed on a top of the piston and guide holes of the nozzle plate may be fitted on the guide protrusions to guide the nozzle plate moving up and down.

The extraction hole formed at the center of the rotary plate and the head of the nozzle that is inserted into the extraction hole may have tapered portions, respectively so that the extraction hole may be rapidly opened and closed.

The rotary plate may have anti-sliding protrusions on the outer side and an indicator for a user to check the degree of rotation of the rotary plate at a predetermined position on the top.

The nozzle hole of the nozzle may be composed of a vertical hole at a center of a lower portion and a horizontal hole formed over the vertical hole and being open to the upper portion of the decompression chamber of the nozzle plate, and the vertical hole and the horizontal hole may be connected to each other so that a cosmetic in the internal container may be extracted to the extraction hole of the rotary plate through the nozzle hole and the upper portion of the decompression chamber.

A decompression piston may be disposed in the decompression chamber of a decompression unit and elastically moved up and down by a lower spring, and when the extraction hole of the rotary plate is closed, the decompression spring may decrease the internal pressure of the internal container to prevent pressure for extracting the cosmetic from being generated too much.

Advantageous Effects of Invention

According to the present invention having the above-described characteristics, the internal container filled with a cosmetic is moved up when the rotary plate is rotated, and the extraction hole of the rotary plate is opened only when the internal container is moved up, so a cosmetic can be simply extracted and an appropriate amount of cosmetic can be extracted so the cosmetic is not wasted.

Further, since the extraction hole is maintained in a closed state by the nozzle when the cosmetic container is carried, and the increasing internal pressure is decreased by the decompression unit, it is possible to prevent a cosmetic from leaking, foreign substance from flowing inside, and external air from coming in contact with the cosmetic, so it is possible to sanitarily keep the cosmetic and use it for a long period of time without changing in quality.

Further, since the piston for providing pressure for extracting a cosmetic is not moved when the internal container is moved up, it is possible to achieve structural stability, as compared with the existing structure in which a piston pressing a cosmetic by moving up or down.

Further, since a back-filling hole for filling a cosmetic is formed through the bottom of the internal container and the cosmetic container can be filled with a cosmetic after being assembled, so assembly productivity of the cosmetic container can be improved and the cosmetic container can be conveniently filled with a cosmetic.

BRIEF DESCRIPTION OF DRAWINGS

FIG. 1 is a perspective view showing an assembly of a cosmetic container according to an embodiment of the present invention.

FIG. 2 is a perspective view showing the cosmetic container according to an embodiment of the present invention, with an upper case open.

FIG. 3 is a cross-sectional view taken along line A-A of FIG. 1.

FIG. 4 is a cross-sectional view taken along the line B-B of FIG. 3.

FIG. 5 is a partial enlarged cross-sectional view of the portion C of FIG. 3.

FIG. 6 is a partial enlarged cross-sectional view of the portion D of FIG. 3.

FIG. 7 is an exploded perspective view showing the cosmetic container according to an embodiment of the present invention.

FIG. 8 is a cross-sectional view showing an example of using a cosmetic with the upper case open in accordance with an embodiment of the present invention.

FIG. 9 is a partial view showing operation of uneven portions of a rotary plate and a nozzle plate according to an embodiment of the present invention.

FIG. 10 is a partial view showing a nozzle that is open in accordance with an embodiment of the present invention.

FIG. 11 is a partial view showing a decompression unit according to an embodiment of the present invention.

FIG. 12 is a perspective view showing the bottoms of the rotary plate and the nozzle plate according to an embodiment of the present invention.

FIG. 13 is a horizontal cross-sectional view showing a mechanism for preventing reverse rotation of the rotary plate when it is combined as in FIG. 12.

DESCRIPTION OF THE REFERENCE NUMERALS IN THE DRAWINGS

100: Rotary-push type cosmetic container
10: Lower case 12: Guide groove
15: Packing hole 20: Upper case
30: Internal container 31: Thread
32: Guide bar 34: Back-filling hole
35: Sealing packing 40: Middle case

45: Ratchet groove 46: Rotation region
50: Piston 52: Guide protrusion
55: Spring 60: Nozzle plate
61: Hole 62: Saw-toothed portion
63: Guide hole 65: Nozzle
66: Head 67: Insertion
68: Nozzle hole 70: Rotary plate
71: Body 72: Saw-toothed portion
73: Tension rib
73*a*: Vertical locking protrusion
74: Sub-tension rib 74*a*: Ratchet protrusion
75: Extraction hole 79: Anti-sliding protrusion
80: Decompression unit 81: Decompression chamber
82: Decompression piston 83: Lower spring

MODE FOR THE INVENTION

Reference will now be made in greater detail to an exemplary embodiment of the present invention, an example of which is illustrated in the accompanying drawings. Wherever possible, the same reference numerals will be used throughout the drawings and the description to refer to the same or like parts.

A rotary-push type cosmetic container according to an embodiment of the present invention, as shown in FIGS. 1 to 13, includes a lower case 10 and an uppercase 20 opening/closing up/down from the lower case 10, in which the lower case 10 and the upper case 20 are locked and unlocked by a locking unit at a side.

There are disposed, inside the lower case 10, an internal case 30 that keeps a cosmetic and has a thread 31 around the outer side, a middle case 40 that is disposed outside the internal case 30 inside the lower case 10 without rotating.

a piston 50 that is inserted in the internal case 30.

a nozzle plate 60 that is disposed on the piston 50 elastically by a spring 55, has a hole 61 at the center where a nozzle is coupled, and has a saw-toothed portion 62 at the edge of the top, a rotary plate 70 that is thread-fastened to the thread 31 on the outer side of the internal container, is coupled to the top of the piston, rotatably combined with a middle case 40 without moving up and down, and has a saw-toothed portion 72 at the edge of the bottom of a body 71 and shaped to correspond to the saw-toothed side 62 of the nozzle plate so that when the body is rotated, the internal container 30 moves up, the nozzle plate 60 elastically moves down, and a head 66 of a nozzle 65 moves away from an extraction hole 75 at the center of the body, and a decompression unit 80 that has a decompression chamber 81 communicating with a nozzle hole 68 of the nozzle 65 outside the upper portion of the hole 61 of the nozzle plate 60 and prevents leakage of a cosmetic by reducing the internal pressure of the internal container 30.

Guide bars 32 are formed around the outer side of the internal container 30 and inserted in guide grooves 12 vertically formed on the inner side of the lower case 10, so the internal container 30 can move up and down, but cannot rotate.

A thread 31 is formed on the outer sides of the guide bars 32 of the internal container 30.

The internal container 30 has a back-filling hole 34 formed through the bottom for filling a cosmetic and a sealing packing 35 that is inserted in a packing hole 15 coaxially formed through the bottom of the lower case 10 and is combined to the back-filling hole 34 after a cosmetic is filled.

The cosmetic that is put in the internal container 30 may be a liquid foundation or a cream type cosmetic having viscosity such as a BB cream, a moisturizing cream, an eye cream, a cold cream, a massage cream, and a nourishing cream.

Locking protrusions 41 on the outer side of the middle case 40 are locked to locking protrusions 11 on the inner side of the lower case 10 to prevent separation, locking projections (not shown) are locked to locking grooves 42 to prevent separation, and the middle case 40 and the upper case 20 are coupled by a hinge 2, so the upper case 20 is rotated up and down to open and close.

The rotary plate 70 has a cosmetic tool seat 79 at the upper portion for keeping cosmetic tools such as a puff 90 and has anti-sliding protrusions 79 on the outer side and an indicator 79*a* at a predetermined position on the top to show the amount of rotation of the rotary plate.

The rotary plate 70 has tension ribs 73 having a vertical locking protrusion 73*a* and formed with regular intervals around the bottom, so when the tension ribs 73 are inserted in the middle case 40, the locking protrusions 73*a* are locked to the bottom of the middle case 40 by the tension of the tension ribs 73. Accordingly, the rotary plate 70 can rotate without separating from the middle case 40.

The tension ribs 73 have a sub-tension rib 74 at the center and a ratchet protrusion 74*a* on the sub-tension rib 74 that stops rotation and ratchet grooves 74*a* for locking the ratchet protrusion 74*a* are formed on the inner side of the middle case 40, so the ratchet protrusions 74*a* can slide over the ratchet grooves 45 in one direction by the tension of the sub-tension ribs 74, but are locked in the opposite direction. Therefore, the rotary plate 70 is rotated in one direction relative to the middle case 40 and not rotated in the opposite direction.

The ratchet grooves 45 may be continuously formed, but it is preferable to form rotation regions 46 between adjacent ratchet grooves 45 so that the ratchet protrusions 74*a* pass the rotation regions 46 and are then locked to the next ratchet grooves 45.

A ring-shaped insertion space 76 is formed on the outer side of the lower portion of the rotary plate 70 so that the internal container 30 is inserted to be movable up and down and the threads 31 on the outer side of the internal container are thread-fastened to a thread 76*a* on the inner side of the insertion space.

The piston 50 that presses a cosmetic when the internal container 30 is moved up is combined to the lower portion of the rotary plate 70 and a coupling groove 51 at the upper portion of the piston 50 is supported on a coupling rib 71 at the lower portion of the rotary plate 70 by a locking step so that the piston 50 is not rotated regardless of rotation of the rotary plate 70. This structure can be achieved by minimizing friction resistance at the combined portion by using different materials for the rotary plate 70 and the piston 50, in which polyacetal (POM) having a high friction property and self-lubrication may be used for the rotary plate 70 and a low density polyethylene may be used for the piston 50. Further, the outer side of the piston 50 is elastically in close contact with the inner side of the internal container 30, so it cannot easily rotate with the rotary plate 70.

A plurality of guide protrusions 52 is formed on the top of the piston 50 and guide holes 63 of the nozzle plate 60 are fitted on the guide protrusions 52 to guide the nozzle plate moving up and down.

That is, as the rotary plate 70 rotates with the saw-toothed portion 72 on the bottom of the rotary plate engaged with the saw-toothed portion 62 on the top of the nozzle plate 60, every time a prominence slides over another prominence, the nozzle plate 60 is elastically moved down and then returned to the degree equivalent to the height of the prominence by the spring 55, thereby guiding the nozzle plate moving up and down.

The extraction hole 75 at the center of the rotary plate 70 and the head 66 of the nozzle 65 that is inserted into the extraction hole 75 have tapered portions 75*a* and 66*a*, respectively, so the extraction hole 75 is rapidly opened and closed.

The nozzle 65 has a lower insertion 67 that is radially cut, so the lower insertion is elastically inserted in a center hole 61 of the nozzle plate and locked by lower locking steps 67*a*. Further, the nozzle has a nozzle hole 68 including a vertical hole 69*a* at the center of the lower portion and a horizontal hole 68*b* formed over the vertical hole and being open to the upper portion of the decompression chamber of the nozzle plate 60, in which the vertical hole 68*a* and the horizontal hole 68*b* are connected to each other. Accordingly, a cosmetic in the internal container 30 is extracted to the extraction hole 75 of the rotary plate 70 through the nozzle hole 68 and the upper portion of the decompression chamber 81.

A decompression piston 82 is disposed in the decompression chamber 81 of the decompression unit 80 and elastically moved up and down by a lower spring 83, so when the extraction hole 75 of the rotary plate is closed, it decreases the internal pressure of the internal container 30 to prevent the pressure for extracting the cosmetic from being excessively generated.

A reference numeral '28' not stated above indicates a mirror.

Operation of the present invention having this configuration is described hereafter.

First, when a user carries the rotary-push type cosmetic container 100 of the present invention, it is in the assembly state as in FIG. 3. In this state, the internal container 30 has been filled with a cosmetic through the back-filling hole 34 and the back-filling hole is closed by a sealing packing 35. Further, since the extraction hole 75 of the rotary plate 70 is closed by the nozzle 65 at the center of the nozzle plate 60 that has been elastically moved up by the spring 55, the cosmetic in the internal container 30 is not unexpectedly extracted or prevented from leaking.

Accordingly, when the cosmetic container 100 is carried for use, the cosmetic can be kept sanitary. Further, since the extraction hole 75 of the rotary plate 70 is closed by the nozzle 65, external air or foreign substance cannot flow inside through the extraction hole, so the cosmetic is prevented from changing in quality or being damaged.

In this state, a user opens the upper case 20 from the lower case 10, as shown in FIG. 7, to extract and use the cosmetic.

Then, when the user rotates the rotary plate 70 in a predetermined direction, the rotary plate 70 rotates in the direction relative to the middle case 40, and as the rotary plate 70 rotates, the internal container 30 is moved up in the insertion space 76.

That is, since the thread 76*a* of the rotary plate and the threads 31 on the outer side of the internal container 30 are thread-fastened to each other and the guide bars 31 on the outer side of the internal container 30 are in the guide groove 12 of the lower case 10, the internal container 30 is moved up when the rotary plate 70 rotated.

Further, the cosmetic in the internal container 30 moved up by rotation of the rotary plate 70 is pressed by the piston 50 over the internal container.

When the rotary plate 70 rotates, the nozzle plate 60 elastically supported by the spring 55 between the rotary plate 70 and the piston 50 is moved up and down with the upward movement of the internal container 30, every time the prominences of the saw-toothed portion 72 on the bottom of the rotary plate 70 and the saw-toothed portion 62 on the top of the nozzle plate 60 slide over other prominences.

As described above, when the nozzle plate 60 is moved up and down, the nozzle 65 in the hole 61 at the center of the nozzle plate is also moved up and down, so the head of the nozzle opens and closes the extraction hole 75 at the center of the rotary plate.

Accordingly, the cosmetic in the internal container 30 is supplied to the nozzle hole 68 of the nozzle, that is, to the decompression chamber 81 of the nozzle plate through the vertical hole 68*a* at the lower portion and the horizontal hole 68*b* at the lower portion of the nozzle, so it is extracted by an appropriate amount every time the head 66 opens the extraction hole 75 of the rotary plate.

Accordingly, a user puts the cosmetic extracted over the rotary plate 70 on the puff 90 or other cosmetic tools, or on his/her hand for application thereof.

A cosmetic is extracted in the way described above and the amount of the cosmetic extracted is adjusted in accordance with the degree of rotation of the rotary plate 70. That is, every time the prominences of the saw-toothed portion 72 of the rotary plate slide over the prominences of the saw-toothed portion, an appropriate amount of cosmetic is extracted, so the extraction amount can be appropriately adjusted.

In detail, when the rotary plate 70 rotates, the head of the nozzle repeats opening and closing the extraction hole 75 of the rotary plate and the cosmetic is extracted, every time the prominences of the saw-toothed portion 72 of the rotary plate slide over the prominences of the saw-toothed portion 62 of the nozzle plate. Accordingly, the amount of the cosmetic extracted at a time is limited, so excessive extraction of the cosmetic is prevented. Further, a user can adjust the degree of rotation of the rotary plate by checking it through the indicator 70*a*, so the user can simply extract the cosmetic by a desired amount by increasing the amount of the cosmetic extracted through the extraction hole 75.

Further, rotary plate 70 rotated by extracting the cosmetic cannot reverse and the internal container 30 is not moved down, so the cosmetic can be stably extracted.

That is, when the rotary plate 70 rotates, the ratchet protrusions 74*a* on the sub-tension ribs 74 at the centers of the tension ribs 73 formed with regular intervals around the outer side of the rotary plate are locked into the ratchet grooves 45 formed on the inner side of the middle case 40 and prevent reverse of the rotary plate 70, so the cosmetic can be stably extracted.

Further, according to the present invention, the pressure applied by the piston 50 to extract the cosmetic increases and extracts the cosmetic, when the internal container 30 is moved up. However, when the pressure for extracting the cosmetic by the internal container 30 is too high, the extraction hole 75 closed by the head 66 is unexpectedly opened and the cosmetic leaks, so leakage of the cosmetic is prevented when the extraction hole 75 is closed by the decompression unit 80 decreasing the pressure for extracting the cosmetic by the internal container 30.

That is, when the pressure for extracting the cosmetic by the internal container 30 is too high, the cosmetic is extracted over the decompression chamber 81 through the nozzle hole 68 of the nozzle, that is, the vertical hole 68*a* and the horizontal hole 68*b* of the nozzle. In this case, the decompression piston 82 at the upper portion in the decompression chamber 81 guides the pressure for extracting the cosmetic to the decompression chamber 81 by moving down against the lower spring 83, thereby decreasing the pressure.

Accordingly, even if the pressure for extracting the cosmetic by the internal container 30 is too high, the pressure passing through the nozzle hole 68 of the nozzle is not sent to the extraction hole 75, as in the related art, but decreased in the decompression chamber 81, so leakage of a cosmetic as in the related art is prevented.

Further, according to the present invention, since the extraction hole 75 at the center of the rotary plate 70 and the head 66 of the nozzle 65 that is inserted into the extraction hole 75 have the tapered portions 75*a* and 66*a*, respectively, the extraction hole 75 is rapidly opened and closed by the head 66 and even hermetically closed.

Further, according to the present invention, since the back-filling hole 34 for filling a cosmetic is formed through the bottom of the internal container 30, a cosmetic can be filled even after the cosmetic container is assembled, so assembly productivity of the cosmetic container can be improved and the cosmetic container can be conveniently filled with a cosmetic.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. A rotary-push type cosmetic container, comprising a lower case and an upper case opening up and closing down with respect to the lower case, wherein, inside the lower case, there are disposed an internal case keeping a cosmetic and having a thread around an outer side, a middle case disposed outside the internal case inside the lower case without rotating, a piston inserted in the internal case, a nozzle plate disposed on the piston elastically by a spring, having a hole at a center where a nozzle is coupled, and having a saw-toothed portion at an edge of a top, a rotary plate thread-fastened to the thread on the outer side of the internal case, coupled to a top of the piston, rotatably combined with the middle case without moving up and down, having a saw-toothed portion at an edge of a bottom of its body, and shaped to correspond to the saw-toothed portion of the nozzle plate so that when the body is rotated, the internal case moves up, the nozzle plate elastically moves down, and a head of a nozzle moves away from an extraction hole at a center of the body, and a decompression mechanism having a decompression chamber communicating with a nozzle hole of the nozzle outside an upper portion of the hole of the nozzle plate and preventing leakage of the cosmetic by reducing internal pressure of the internal container.

2. The rotary-push type cosmetic container of claim 1, wherein guide bars are partially formed around the outer side of the internal case and inserted in guide grooves vertically formed on an inner side of the lower case, so the internal case is movable up and down without rotating.

3. The rotary-push type cosmetic container of claim 1, wherein the internal case has a back-filling hole formed through its bottom for filling a cosmetic and a sealing packing inserted in the back-filling hole coaxially formed through a bottom of the lower case.

4. The rotary-push type cosmetic container of claim 1, wherein the rotary plate has tension ribs having a vertical locking protrusion and formed with regular intervals around a bottom of the rotary plate and the vertical locking protrusions are locked to a lower end of the middle case, and the tension ribs have a sub-tension rib at a center and a ratchet protrusion on the sub-tension rib for stopping rotation and ratchet grooves for locking the ratchet protrusions are formed on an inner side of the middle case, so the ratchet protrusions slide over the ratchet grooves in one direction by tension of the sub-tension ribs, but are locked in the opposite direction.

5. The rotary-push type cosmetic container of claim 1, wherein a plurality of guide protrusions are formed on a top of the piston and guide holes of the nozzle plate are fitted on the guide protrusions to guide the nozzle plate moving up and down.

6. The rotary-push type cosmetic container of claim 1, wherein the extraction hole formed at the center of the rotary plate and the head of the nozzle that is inserted into the extraction hole have tapered portions, respectively so that the extraction hole is rapidly opened and closed.

7. The rotary-push type cosmetic container of claim 1, wherein the rotary plate has anti-sliding protrusions on an outer side and an indicator for a user to check the degree of rotation of the rotary plate at a predetermined position on the top.

8. The rotary-push type cosmetic container of claim 1, wherein the nozzle hole of the nozzle is composed of a vertical hole at a center of a lower portion and a horizontal hole formed over the vertical hole and being open to the upper portion of the decompression chamber of the nozzle plate, and the vertical hole and the horizontal hole are connected to each other so that a cosmetic in the internal container is extracted to the extraction hole of the rotary plate through the nozzle hole and the upper portion of the decompression chamber.

9. The rotary-push type cosmetic container of claim 1, wherein the decompression mechanism includes a decompression piston disposed in the decompression chamber elastically moved up and down by a lower spring, and when the extraction hole of the rotary plate is closed, the decompression spring decreases the internal pressure of the internal case to prevent pressure for extracting the cosmetic from being generated.

* * * * *